United States Patent [19]

Cheng et al.

[11] Patent Number: 4,550,424

[45] Date of Patent: Oct. 29, 1985

[54] PM DECODER SAMPLE AND HOLD CIRCUIT

[75] Inventors: Fred T. J. Cheng; Don R. Sauer, both of San Jose, Calif.

[73] Assignee: National Semiconductor Corporation, Santa Clara, Calif.

[21] Appl. No.: 578,403

[22] Filed: Feb. 9, 1984

[51] Int. Cl.[4] ..... H04H 5/00

[52] U.S. Cl. ..... 381/15; 329/103; 329/110; 329/137

[58] Field of Search ..... 381/15, 2, 3, 4; 329/103, 110, 137, 139, 140, 143

[56] References Cited

U.S. PATENT DOCUMENTS

| | | | |
|---|---|---|---|
| 4,362,999 | 12/1982 | Sauer | 381/15 |
| 4,379,208 | 4/1983 | Isbell et al. | 381/15 |
| 4,430,747 | 2/1984 | Streeter | 381/15 |
| 4,479,234 | 10/1984 | Yokoya et al. | 381/15 |

*Primary Examiner*—Forester W. Isen

*Attorney, Agent, or Firm*—Gail W. Woodward; Paul J. Winters; Michael J. Pollock

[57] ABSTRACT

An AM stereo receiver decoder is shown. An AM detector produces the stereo L+R signal and a PM detector produces the L−R signal. The PM detector is created from a conventional FM detector that employs an input limiter driving a balanced multiplier. The limiter also drives a tuned circuit which provides quadrature drive to the multiplier. An integrator connected to the FM detector converts the response to a PM decoder. A large value inductor is simulated to appear across the integrator so as to create a low modulation frequency resonance at a subaudible frequency thereby providing a controlled pilot tone response. The inductor is simulated by the action of a first $G_m$ amplifier driving a capacitor which drives a second $G_m$ amplifier having an output coupled back to the input of the first $G_m$ amplifier. The capacitor is switched by means of a series connected switch that disconnects the capacitor when the AM exceeds a predetermined value. This means that when the L+R negative modulation peaks exceed some predetermined value the simulated inductor acts to short out the L−R signal channel. Since the switch is in series with the capacitor, the charge cannot vary when the switch is open, thereby creating a sample and hold action.

8 Claims, 2 Drawing Figures

PM DECODER SAMPLE AND HOLD CIRCUIT

BACKGROUND OF THE INVENTION

The invention relates to AM stereo broadcast receivers. In the proposed systems L+R signal information is transmitted using a conventional amplitude modulated (AM) carrier wave. The L−R signal information is transmitted using phase modulation (PM) carrier information. Since a conventional radio receiver cannot react to the PM it will provide a compatible receiver response to the stereo broadcast. However, if the receiver is equipped with a PM decoder and matrix circuit, the L and R information can be reproduced to provide stereo audio.

U.S. Pat. No. 4,362,999 issued Dec. 7, 1982, to Don R. Sauer and is assigned to the assignee of the present invention. This patent relates to an AM STEREO PHASE MODULATION DECODER and its teaching is incorporated herein by reference. This patent discloses a combination FM detector and integrator to provide a PM decode. It is shown that such a combination reduces signal radiation, is linear, and has a reduced adverse response to noise and overmodulation. A simulated large value inductor is also disclosed for controlling the audio response and stabilizing the decoder performance.

In the typical AM stereo receiver the PM decoder is driven from a limiter that is in turn driven from the receiver IF amplifier. When the carrier is strongly modulated by the L+R signal, it is common for overmodulation to occur on occasional signal peaks. Normally this condition is minimized but does occur to some degree. During such overmodulation conditions the carrier goes to zero, or at least well below the limiting level, so that the PM decoder receives no signal for a brief interval. This can result in what appears to be noise at the decoder output and can be objectionable.

SUMMARY OF THE INVENTION

It is an object of the invention to mute the PM decoder in an AM stereo receiver when the carrier is overmodulated.

It is a further object of the invention to incorporate a simulated inductor into an AM stereo PM decoder and to disable the inductor action during negative overmodulation peaks such that the PM response is muted during such peaks.

It is a still further object of the invention to simulate an inductor in a PM decoder and to use the disabling of the inductor action to sample and hold the tuning or frequency of the decoder in its state prior to disabling such that the transients normally associated with overmodulation can be avoided.

These and other objects are achieved as follows. A PM decoder is driven from a signal limiter that is coupled to the IF section of a broadcast receiver. The PM decoder is composed of a multiplier and a resonant circuit that generates a quadrature IF signal. The multiplier operates on the IF and the quadrature signals to produce an FM output. By integrating the FM output a PM response is produced. The PM response conveys the stereo L−R modulation information which when matrixed with the L+R modulation, available from a conventional AM detector, produces L and R information signals. When these signals are applied by conventional amplifiers to left and right speakers, stereo sound is reproduced. In the AM stereo proposals a subaudible pilot carrier is inserted on the L−R signal channel to denote the presence of a stereo signal. In order to provide adequate output from the PM decoder at the lower modulation frequencies the integrator capacitor is tuned by a large value simulated inductor. To simulate an inductor a first transconductance ($G_m$) amplifier is driven by the integrator output and is coupled to drive a capacitive load element. Such a drive combination produces an output voltage that lags the signal current by about 90 degrees. A second $G_m$ amplifier responds to the capacitor voltage and is coupled to drive the multiplier load elements. This completes a negative feedback loop in which the output current leads the voltage by 90 degrees thereby simulating an inductor. The value of the inductor is determined by both amplifier's gains (or $G_m$s) and the value of the capacitor. The inductor can be disabled by incorporating a switch in series with the capacitor. When the switch is closed the circuit acts normally to simulate the inductor. When the switch is opened the capacitor is disconnected and the circuit will simply act to force the differential output of the PM decoder output to zero. This action eliminates the L−R signal so the system output consists of L+R in both output channels. Thus the stereo is muted when the capacitor is disconnected. Switching is accomplished in response to a control circuit which is driven from the AM detector and is arranged to be responsive to the AM on the carrier. When the downward modulation level exceeds some predetermined level the control circuit turns the switch off so as to mute the stereo. Since the capacitor charge cannot vary while it is disconnected, the circuit will resume its normal operation when the capacitor is reconnected. Thus, a sample and hold function is achieved wherein excessive negative modulation peaks mute the stereo when they exceed a predetermined value.

DESCRIPTION OF THE INVENTION

Figure 1:
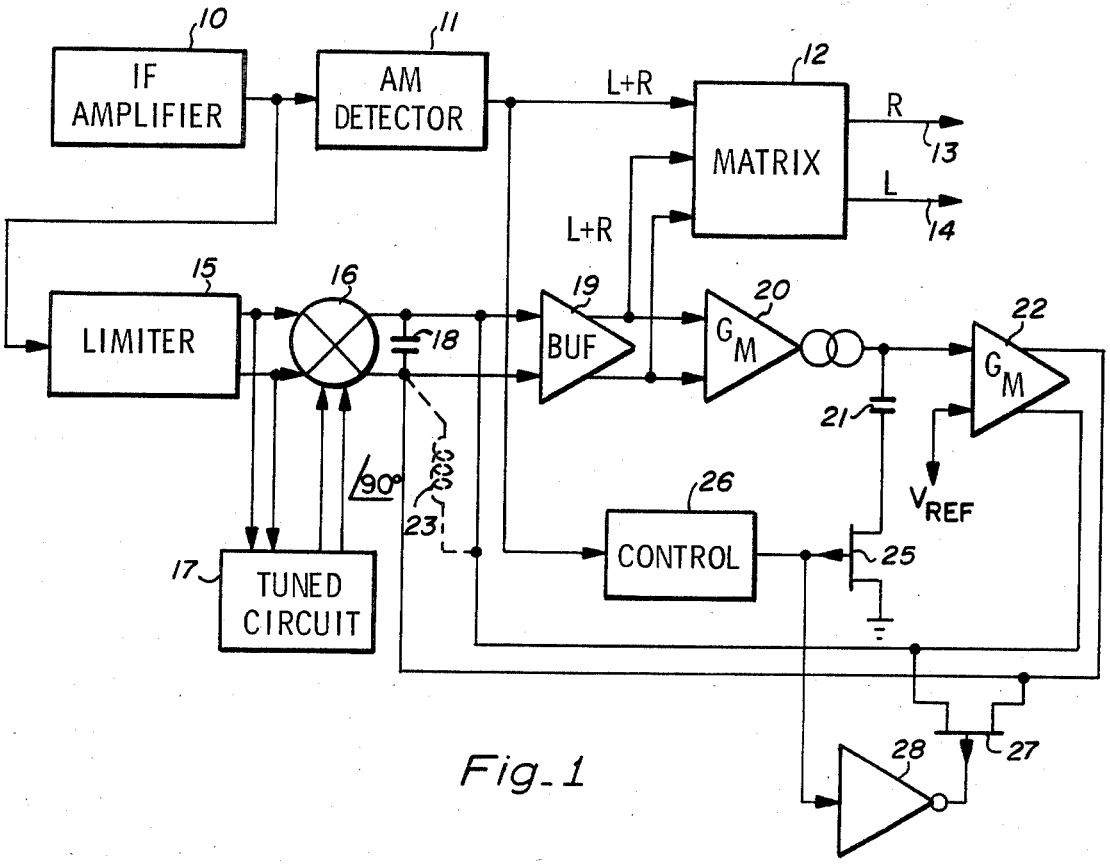
FIG. 1 is a block diagram of the stereo portion of an AM stereo radio receiver.

FIG. 1 shows a block diagram of the stereo portion of an AM stereo radio. Only the IF amplifier is shown but it is to be understood that the conventional radio receiver elements are normally connected ahead of the circuitry shown.

IF amplifier 10 drives AM detector 11 which produces the L+R stereo information. This signal is fed to matrix 12 which, when supplied with an L−R signal, will produce R and L signals on outputs 13 and 14 respectively. These outputs feed a conventional stereo amplifier and speaker combination (not shown). If amplifier 10 also drives limiter 15 which in turn drives a PM detector that is made up of multiplier 16 and tuned circuit 17 connected as a conventional FM detector.

Limiter 15 applies a signal to multiplier 16 and to a tuned circuit 17 which provides a tuning sensitive quadrature signal to another input of multiplier 16. The output of multiplier 16 is fed into an integrator in the form of capacitor 18 which converts the FM detector to a PM decoder. Thus, the output of multiplier 16 comprises the PM decoded contents of the receiver IF. In AM stereo this signal is the L−R channel. Buffer 19 couples the L−R signal to matrix 12.

Buffer 19 also drives $G_m$ amplifier 20 which in turn applies a signal current to capacitor 21. The signal across capacitor 21 drives $G_m$ amplifier 22 which in turn is coupled back to the output of multiplier 16. The loop comprising buffer 19 and amplifiers 20 and 22 simulates inductor 23 which is shown in dashed outline. Such an inductor has very low d-c resistance and a reactance that rises with frequency. Capacitor 18 is chosen to act as an integrator at the output of multiplier 16 and inductor 23 is chosen to raise the circuit impedance at very low modulation frequencies to a reasonable value. This action sets the low frequency response of the circuit such that the low frequency stereo pilot tone is at a suitable level.

The function of the circuits in blocks 15–22 is covered in detail in U.S. Pat. No. 4,362,999 referenced above. This patent also discloses circuitry suitable for the IC form of these elements.

The present invention relates to the addition of switch 25 in series with capacitor 21 and control 26 which actuates switch 25. In its preferred version as shown switch 25 is a P channel field effect transistor (FET). The output of control 26 is normally low so as to turn switch 25 on. When the modulation out of AM detector 11 develops a negative peak that is below a predetermined value, the output of control 26 goes high and turns switch 25 off. This disconnects capacitor 21 and the inductor simulating circuit presents a very low impedance across the output terminals of multiplier 16 at all audio frequencies. The result is that the L−R signal to matrix 12 is eliminated. In effect the value of inductor 22 becomes very small so that it acts as a short circuit at the L−R audio frequencies.

Figure 2:
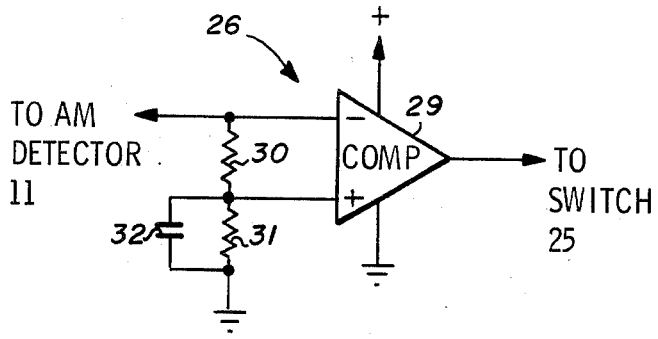
FIG. 2 is a diagram of a preferred control circuit.

FIG. 2 shows a circuit suitable for providing the control 26 function of FIG. 1. A comparator 29 has its output coupled to switch 25. The inverting (−) input is coupled directly to AM detector 11. The non-inverting (+) input is coupled by way of a low pass filter to an attenuator connected across the output of detector 11. Resistors 30 and 31 form a voltage divider that connects a fraction of the detector 11 output to the non-inverting comparator input. Capacitor 32 acts as a low impedance to the audio signals. It will charge to a value equal to the average output of detector 11 multiplied by the division ratio of resistors 30 and 31. As long as the signal applied to the inverting input exceeds the reference established at the non-inverting input the comparator output will remain low and the circuit will function normally. However, as the modulation level increases there will be a point where the negative peaks will drop below the reference level across capacitor 32. When this happens the output of comparator 29 will go high and switch 25 will disconnect capacitor 21 thereby muting the stereo as described above. The actual level at which the switching will occur is determined by resistors 30 and 31. For example, if the voltage division ratio is 10:1 comparator 29 will switch at modulation levels above 90% but only on the negative peaks. Increasing the division ratio will increase the modulation percentage where switching occurs.

As shown above the inductor simulating circuitry will provide a very low signal impedance at the output terminals of multiplier 16 in the muted state due to the action of switch 25. If desired a second switch 27 operated by inverter 28 can be added to the circuit. Switch 27 is normally open for normal circuit operation and it is turned on when the L−Rsignal is to be eliminated. The presence of inverter 28 forces switch 27 to operate complimentarily with switch 25. In this case both switches will be of the same type. However, if switch 27 is an N channel FET while switch 25 is a P channel FET, inverter 28 would be eliminated and both switches directly connected to control 26.

While FET devices are preferred as switching elements, other device types can be employed. For example, IGFET switch structures could be employed.

The invention has been described and a preferred embodiment set forth. When a person skilled in the art reads the foregoing description, alternatives and equivalents, within the spirit and intent of the invention, will become apparent. For example, while the invention has been described as it applies to an AM stereo PM decoder, it could have applications wherever a PM decoder is muted to achieve a sample and hold function. Accordingly, it is intended that the scope of the invention be limited only by the following claims.

We claim:

1. An AM stereo demodulator circuit in which an L+R signal is amplitude modulated on a carrier wave and an L−R signal is phase modulated on said carrier wave, said L+R and L−R signals being combined to produce L and R stereo signals, said circuit comprising:

an amplitude modulation (AM) detector for producing an L+R signal output;

a phase modulation (PM) detector for producing an L−R signal output, said PM detector comprising a multiplier in combination with an integrator;

means for simulating an inductor coupled across said integrator, said inductor having a value that will resonate said integrator at a subaudible frequency; and means for disabling said means for simulating an inductor when said L+R signal is modulated in excess of a predetermined level.

2. The circuit of claim 1 wherein said means for disabling comprise switch means operated in response to a control circuit that is coupled to said AM detector.

3. The circuit of claim 2 wherein said control circuit comprises:

a comparator having an output coupled to operate said switch means, a noninverting input coupled to said AM detector, and an inverting input;

a voltage divider coupled to said AM detector and having an output that represents a fraction of the output of said AM detector;

a first capacitor coupled to said voltage divider output and having a value selected to bypass the associated audio signal components; and means for coupling said voltage divider output to said inverting input of said comparator whereby said comparator output is high for AM below a predetermined value and is low when said AM exceeds said predetermined value.

4. The circuit of claim 3 wherein said means for simulating an inductor comprise a first transconductance amplifier having an input coupled to said integrator and an output coupled to drive a second capacitor, a second transconductance amplifier having an input coupled to said second capacitor and an output coupled to said integrator thereby creating a feedback loop around said integrator wherein the simulated inductor has a value related to said second capacitor and first switch means coupled in series with said second capacitor and actuated from the output of said comparator.

5. The circuit of claim 4 further comprising second switch means coupled across said integrator and actuated by said comparator in complementary fashion with respect to said first switch means.

6. A phase modulation (PM) detector circuit for responding to an input signal that contains phase related information and to provide an output that contains said information, said circuit comprising:

a PM detector having an input coupled to receive a phase modulated signal and an integrated output;

means for simulating an inductor coupled to said integrated output;

means for disabling said inductor to achieve a sample and hold function for said phase modulated signal.

7. The circuit of claim 6 wherein said means for simulating an inductor comprise:

a first transconductance amplifier having an input coupled to be driven from said integrated output of said PM detector and an output coupled to drive a capacitor; and a second transconductance amplifier having an input coupled to said capacitor and an output coupled to said integrated output of said PM detector thereby creating a feedback loop which simulates an inductor.

8. The circuit of claim 7 wherein said means for disabling comprise a switch in series with said capacitor.

* * * * *